US007867154B2

(12) United States Patent
Teeter et al.

(10) Patent No.: US 7,867,154 B2
(45) Date of Patent: Jan. 11, 2011

(54) ANGLE ADJUSTING MECHANISM FOR TILTING INVERSION EXERCISER

(76) Inventors: Roger C. Teeter, 20720 Snag Island Dr., Sumner, WA (US) 98390; Lopin Wang, 16F-2, No. 62, Sec. 2, Chonder 2$^{nd}$, Beitun Chu, Taichung, 40652 (TW)

( * ) Notice: Subject to any disclaimer, the term of this patent is extended or adjusted under 35 U.S.C. 154(b) by 109 days.

(21) Appl. No.: 12/387,370

(22) Filed: May 1, 2009

(65) Prior Publication Data

US 2010/0279838 A1 Nov. 4, 2010

(51) Int. Cl.
*A63B 26/00* (2006.01)

(52) U.S. Cl. ..... 482/144; 482/908

(58) Field of Classification Search ..... 482/51, 482/92–96, 98–100, 140, 142–145, 907–908; 297/83–84, 325, 327; 128/845; 601/1, 23–26; 108/6, 8, 13; 5/610; 248/163.2, 371, 372.1, 248/397; 292/137, 145–146, 150, 163; *A63B 26/00*
See application file for complete search history.

(56) References Cited

U.S. PATENT DOCUMENTS 4,531,731 A * 7/1985 Law ..... 482/144
5,102,121 A * 4/1992 Solow et al. ..... 482/94
5,356,360 A * 10/1994 Johns ..... 482/99
5,722,921 A * 3/1998 Simonson ..... 482/100
6,679,818 B2 * 1/2004 Hsien ..... 482/144
7,125,372 B1 10/2006 Teeter et al. ..... 482/144
7,500,939 B2 * 3/2009 Chen ..... 482/144

* cited by examiner

*Primary Examiner*—Loan Thanh
*Assistant Examiner*—Oren Ginsberg
(74) *Attorney, Agent, or Firm*—Charles E. Baxley

(57) ABSTRACT

A tilting inversion exerciser includes a supporting stand having a plate formed in each of two housings, and a curved channel formed in each plate and formed by two end stops, two arms each having a board formed in a casing and pivotally coupled to the plate with a pivot axle for supporting a user supporting table, the board includes a guide pin slidably engaged in the curved channel of the plate, a panel includes an anchor engageable into the curved channel of the plate for forming a shortened moving path between the anchor of the panel and the end stop of the plate, and for limiting the guide pin of the board to slide along the shortened moving path, and a latch member changeably secures the anchor and the panel to the housing at different angular position.

10 Claims, 12 Drawing Sheets

ANGLE ADJUSTING MECHANISM FOR TILTING INVERSION EXERCISER

BACKGROUND OF THE INVENTION

1. Field of the Invention

The present invention relates to a tilting inversion exerciser, and more particularly to an adjustable tilting inversion exerciser including an angle adjusting mechanism for suitably adjusting the angular position between the user supporting table and the lower supporting stand and for limiting the user supporting table to rotate relative to the lower supporting stand and for preventing the user supporting table from being over rotated relative to the lower supporting stand.

2. Description of the Prior Art

Typical tilting inversion exercisers comprise a user supporting table pivotally or rotatably supported on a lower support stand, for supporting a user thereon, and for allowing the user to tilt or to incline the table relative to the lower support, in order to conduct the typical tilting inversion exercises.

For example, U.S. Pat. No. 7,125,372 to Teeter discloses one of the typical rotatable or tilting inversion exercisers comprising a stationary support stand composed of spaced A-frames having spaced trunnion supporting bearing plates and hanger bars for pivotally or rotatably supporting a user supporting table and for allowing the user supporting table to be pivoted or rotated relative to the stationary support stand.

However, there is no limiting mechanism formed or provided between the user supporting table and the stationary lower support stand, and the user supporting table may be rotated relative to the lower supporting stand for more than one hundred eighty (180) degrees, such that the typical rotatable or tilting inversion exercisers are not suitable for the users of worse body forms or physiques, such as the children and elders.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including an angle adjusting mechanism for suitably adjusting the angular position between the user supporting table and the lower supporting stand and for limiting the user supporting table to rotate relative to the lower supporting stand and for preventing the user supporting table from being over rotated relative to the lower supporting stand.

In accordance with one aspect of the invention, there is provided a tilting inversion exerciser comprising a supporting stand including two housings each having a plate, the plate of the housing including a curved channel formed therein and defined by a first end stop and a second end stop, two arms each including a casing having a board pivotally attached and coupled to the plate of the housing with a pivot axle for pivotally coupling the casing to the housing, the board including a guide pin attached thereto and slidably received and engaged in the curved channel of the plate for guiding and limiting the board and the casing to rotate relative to the housing, a user supporting table attached to the arms for pivoting relative to the housing of the supporting stand, a panel pivotally attached onto the pivot axle and including an anchor engageable into the curved channel of the plate for forming a shortened moving path between the anchor of the panel and the second end stop of the plate, and for limiting the guide pin of the board to slide along the shortened moving path between the anchor of the panel and the second end stop of the plate, and a latch member slidably attached to the plate of the housing and engageable with the panel for changeably securing the anchor and the panel to the housing at different angular positions.

The panel includes a plurality of apertures formed therein for selectively or changeably engaging with the latch member and for changeably securing the panel to the housing at different angular positions.

A control ferrule may further be provided and pivotally attached onto the casing and coupled to the panel for rotating the panel relative to the casing to any suitable or selected angular positions.

The control ferrule includes a depression formed therein, and the panel includes an ear extended outwardly therefrom and engaged with the depression of the control ferrule for securing the panel to the control ferrule.

The casing includes a chamber formed therein, and includes a curved passage formed therein and communicative with the chamber of the casing, and the ear of the panel is slidably received and engaged in the curved passage of the casing for guiding and limiting the panel to rotate relative to the casing.

The plate includes a barrel extended outwardly therefrom and having a bore formed in the barrel for slidably receiving the latch member. The housing includes a cap attached to the barrel for confining or retaining the latch member within the bore of the barrel.

The latch member includes a latch end extended out through the plate, and a spring member is engaged onto the latch member for biasing and forcing the latch end of the latch member to engage out through the plate.

The latch member includes an enlarged peripheral flange extended outwardly therefrom for engaging with the plate and for limiting the latch member to slide relative to the plate and the housing.

The housing includes a cover attached to the housing for blocking the chamber of the housing, the cover includes an orifice formed therein, and the latch member includes a free end extended out through the orifice of the cover and secured to a knob for pulling the latch member relative to the spring member.

A connecting collar may further be provided and rotatably disposed and engaged between the housing and the casing, and includes two opposite inner peripheral recesses formed therein for engaging with the housing and the casing respectively and for stably and rotatably anchoring and positioning the housing and the casing to each other.

The housing includes a compartment formed in the plate for receiving a bearing which is engaged with the pivot axle, and which is secured to the plate with a retaining ring for stably and rotatably anchoring and securing the plate of the housing and the board of the casing together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
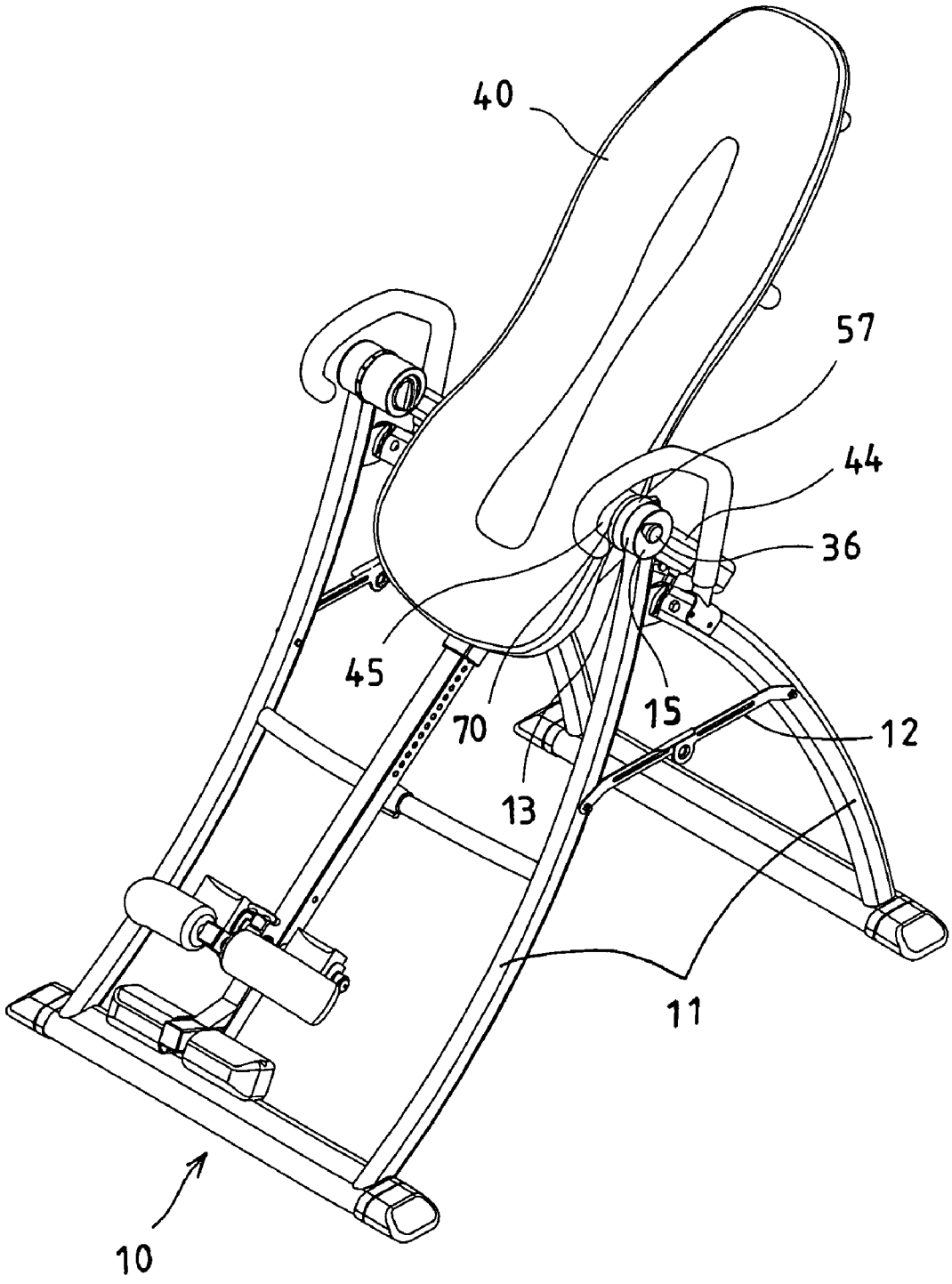
FIG. 1 is a perspective view of a tilting inversion exerciser in accordance with the present invention.
Figure 2:
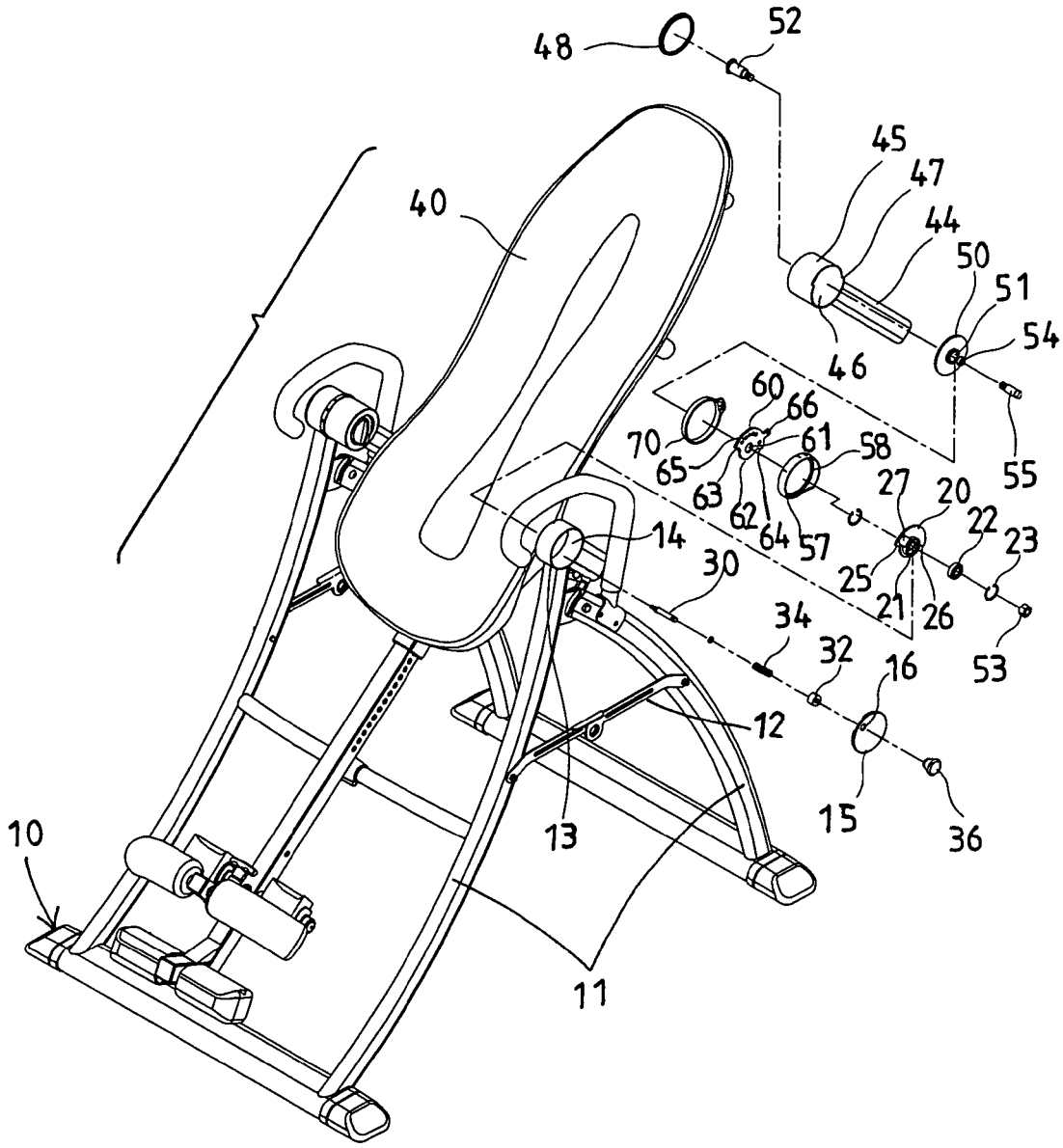
FIG. 2 is a partial exploded view of the tilting inversion exerciser.
Figure 3:
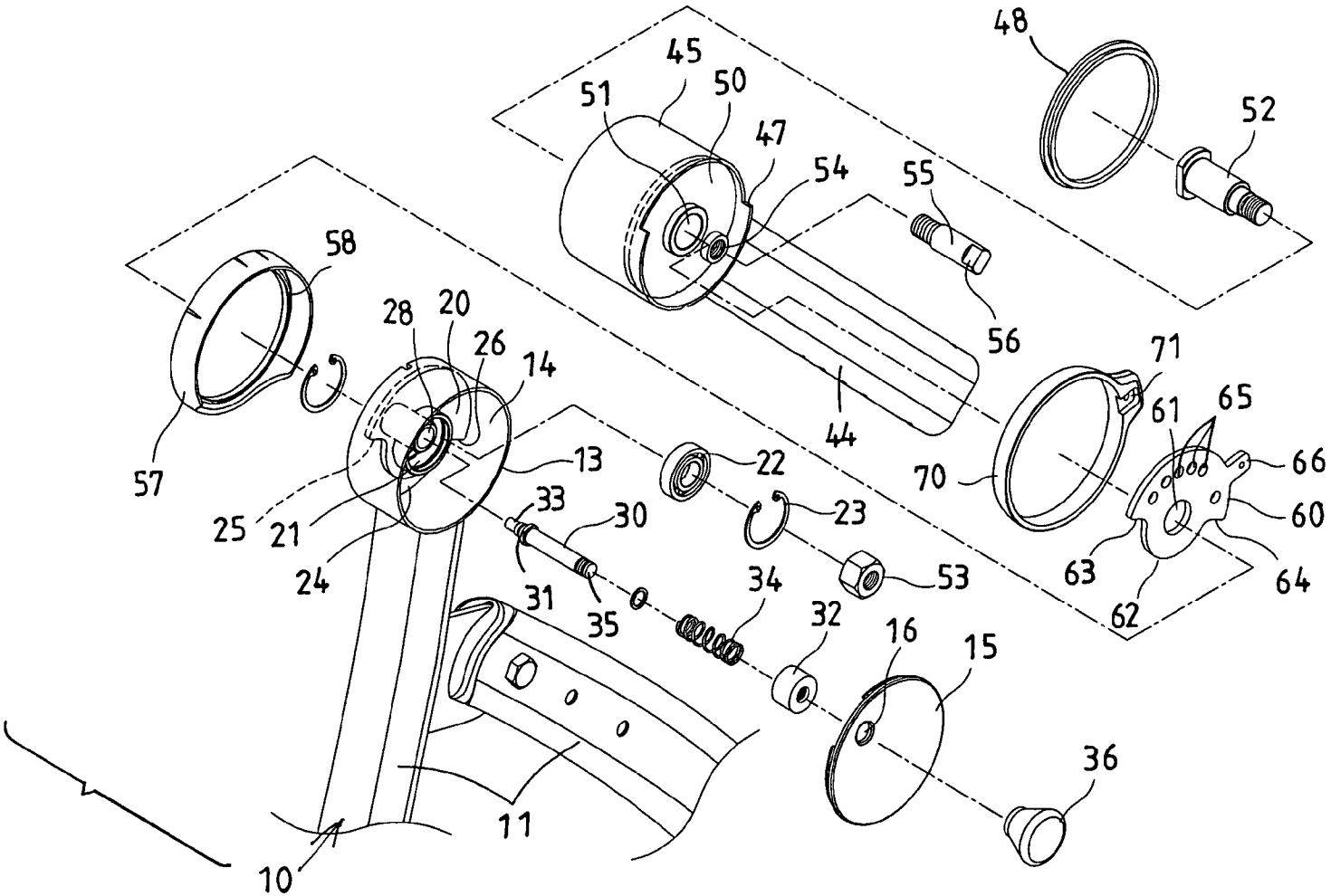
FIG. 3 is another partial exploded view of the tilting inversion exerciser.

Referring to the drawings, and initially to FIGS. 1 and 2, a tilting inversion exerciser in accordance with the present invention comprises a lower supporting stand 10 for pivotally or rotatably supporting a user supporting base or table 40 thereon, and then for supporting a user 8 on the user supporting table 40, the lower supporting stand 10 includes such as two U-shaped stand members 11 having upper ends pivotally coupled together so as to form a substantially inverted V-shaped and foldable structure, and includes one or more, such as two foldable coupler 12 coupled between the stand members 11 for allowing the stand members 11 of the supporting stand 10 to be folded to a compact folding structure when the foldable coupler 12 is folded, and for allowing the stand members 11 of the supporting stand 10 to be stably supported on a working position when the foldable coupler 12 is opened or unfolded to an open position as shown in FIGS. 1-2, 9-10, and 12-14.

The lower supporting stand 10 may further include a motor driving means or motor and/or a reduction gearing (not shown) disposed or attached or secured to the upper ends of the lower supporting stand 10 for driving or rotating the user supporting table 40 relative to the lower supporting stand 10. As shown in FIGS. 9-10, and 13-14, a frame 41 is provided and includes a longitudinal beam 42 for attaching or securing or supporting the user supporting table 40 thereon, and includes two sleeve 43 extended or formed or secured on the two sides of the beam 42 or the beam 41, and two arms 44 are slidably or adjustably received or engaged with the sleeves 43 for adjustably securing the sleeves 43 and the frame 40 and the user supporting table 40 to the arms 44, in which the arms 44 may form or act as a carrier 4 for adjustably and rotatably securing the frame 40 and the user supporting table 40 to the lower supporting stand 10. The sliding attachment between the arms 44 and the sleeves 43 of the frame 40 is not related to the present invention and will not be described in further details.

Figure 4:
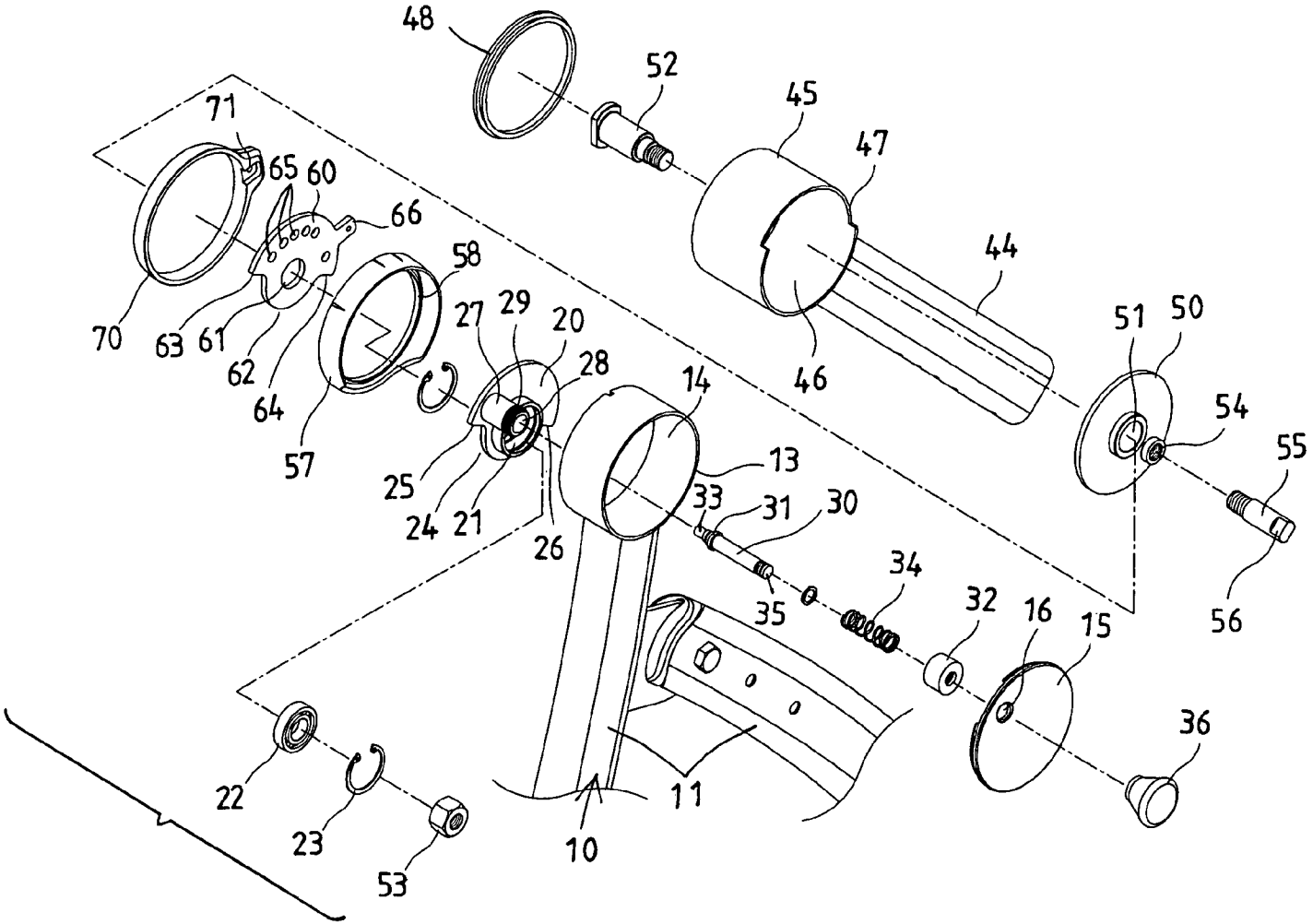
FIG. 4 is a further partial exploded view of the tilting inversion exerciser.
Figure 5:
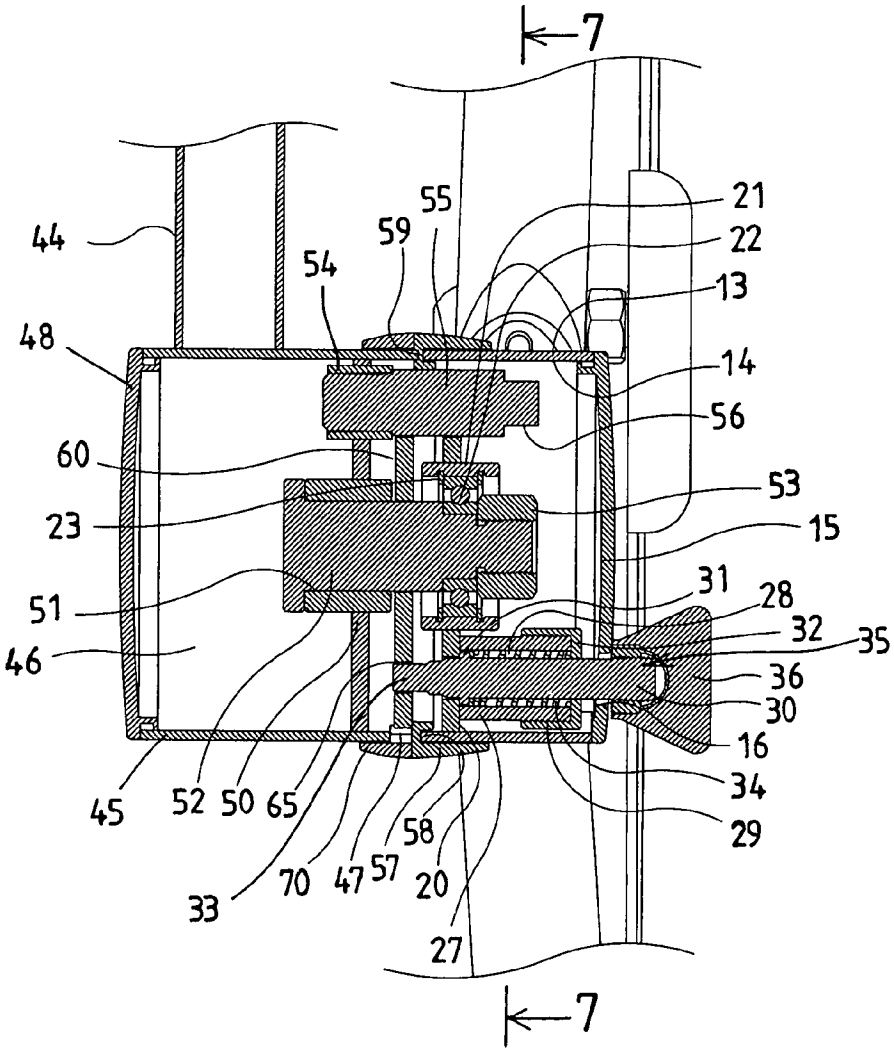
FIG. 5 is a partial cross sectional view taken along lines 5-5 of FIG. 7.
Figure 6:
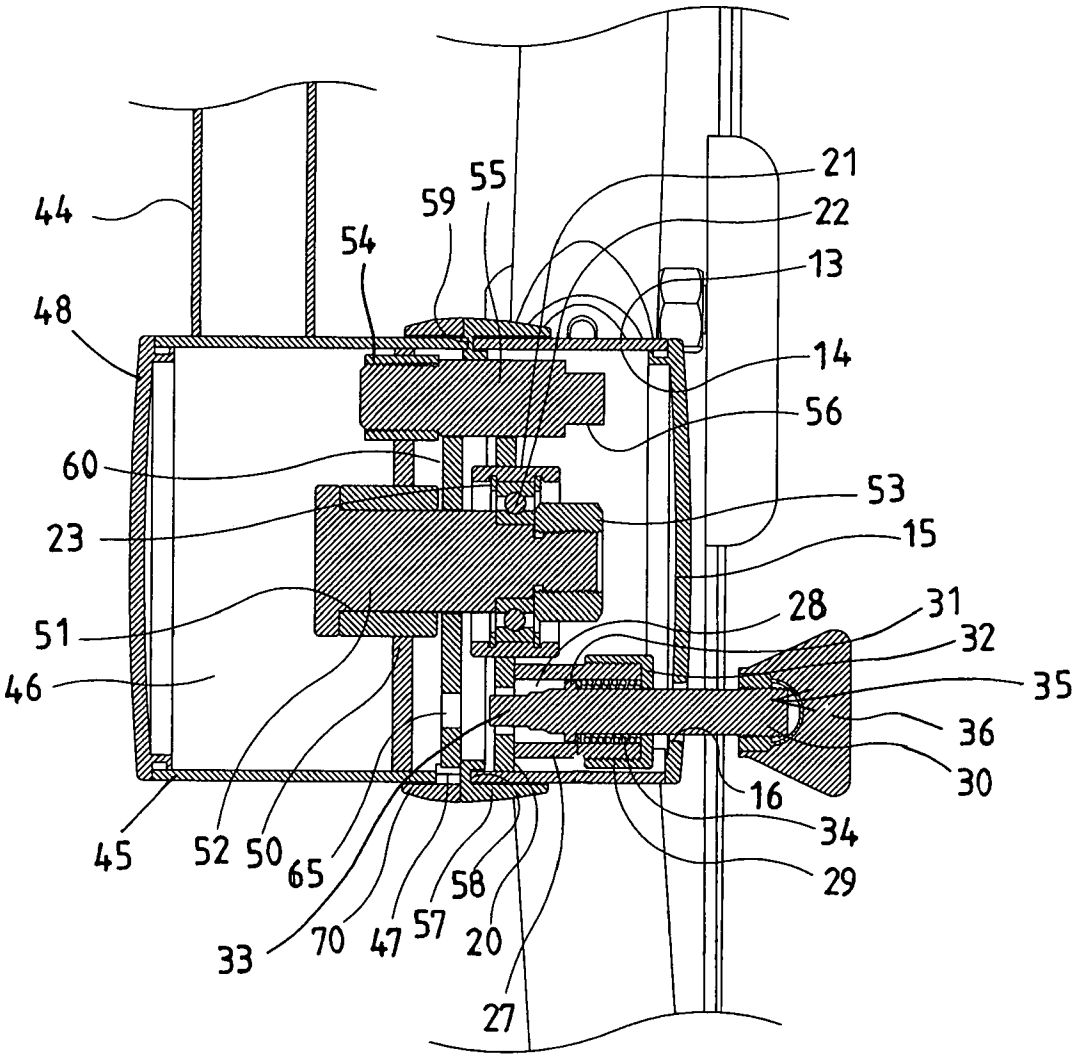
FIG. 6 is a partial cross sectional view similar to FIG. 5 illustrating the operation of the tilting inversion exerciser.
Figure 8:
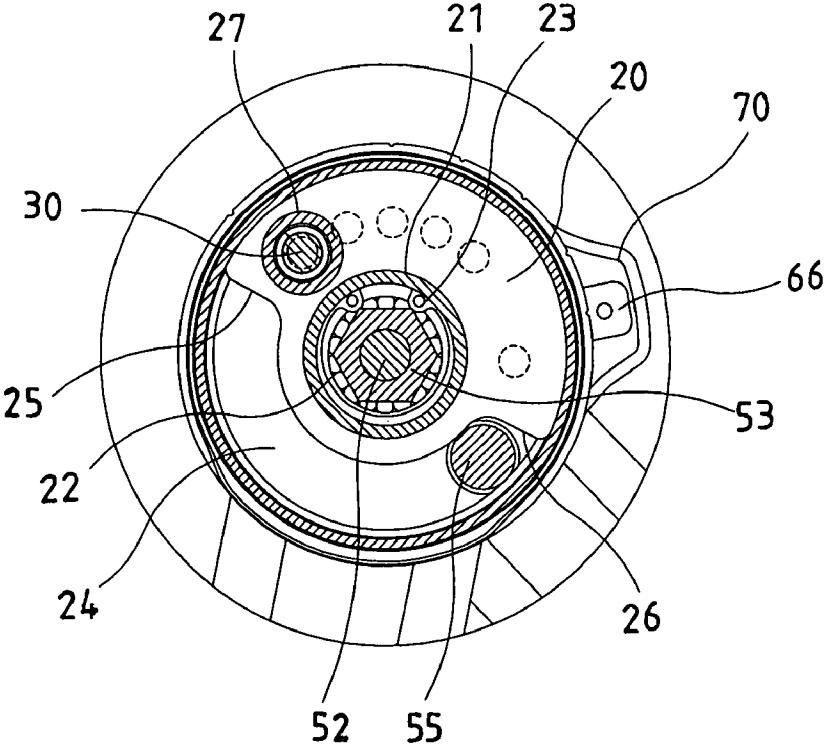
FIG. 8 is a further cross sectional view similar to FIG. 7 illustrating the operation of the tilting inversion exerciser.
Figure 7:
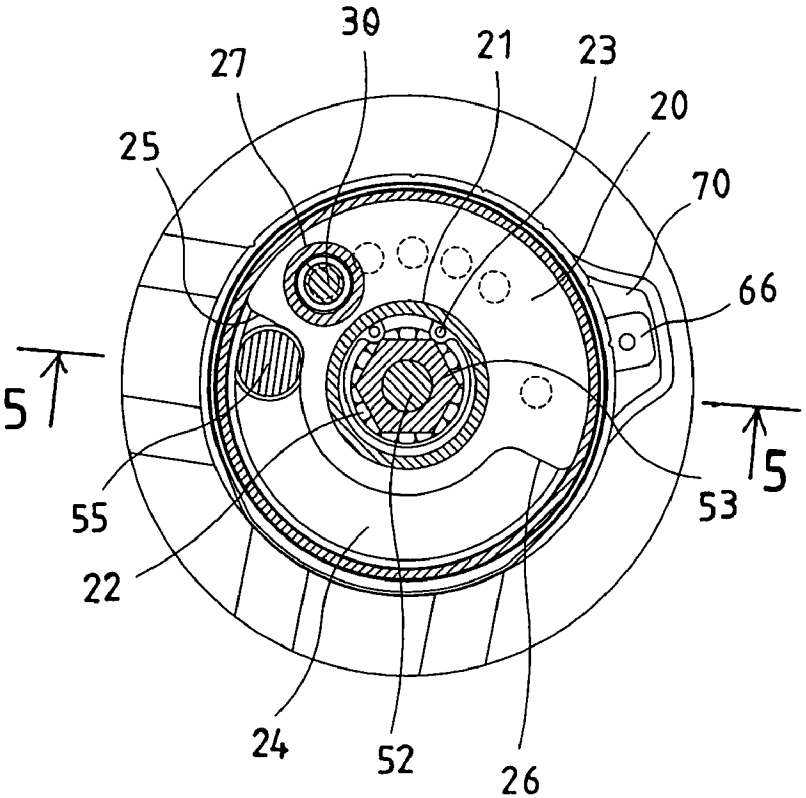
FIG. 7 is another cross sectional view taken along lines 7-7 of FIG. 5.
Figure 9:
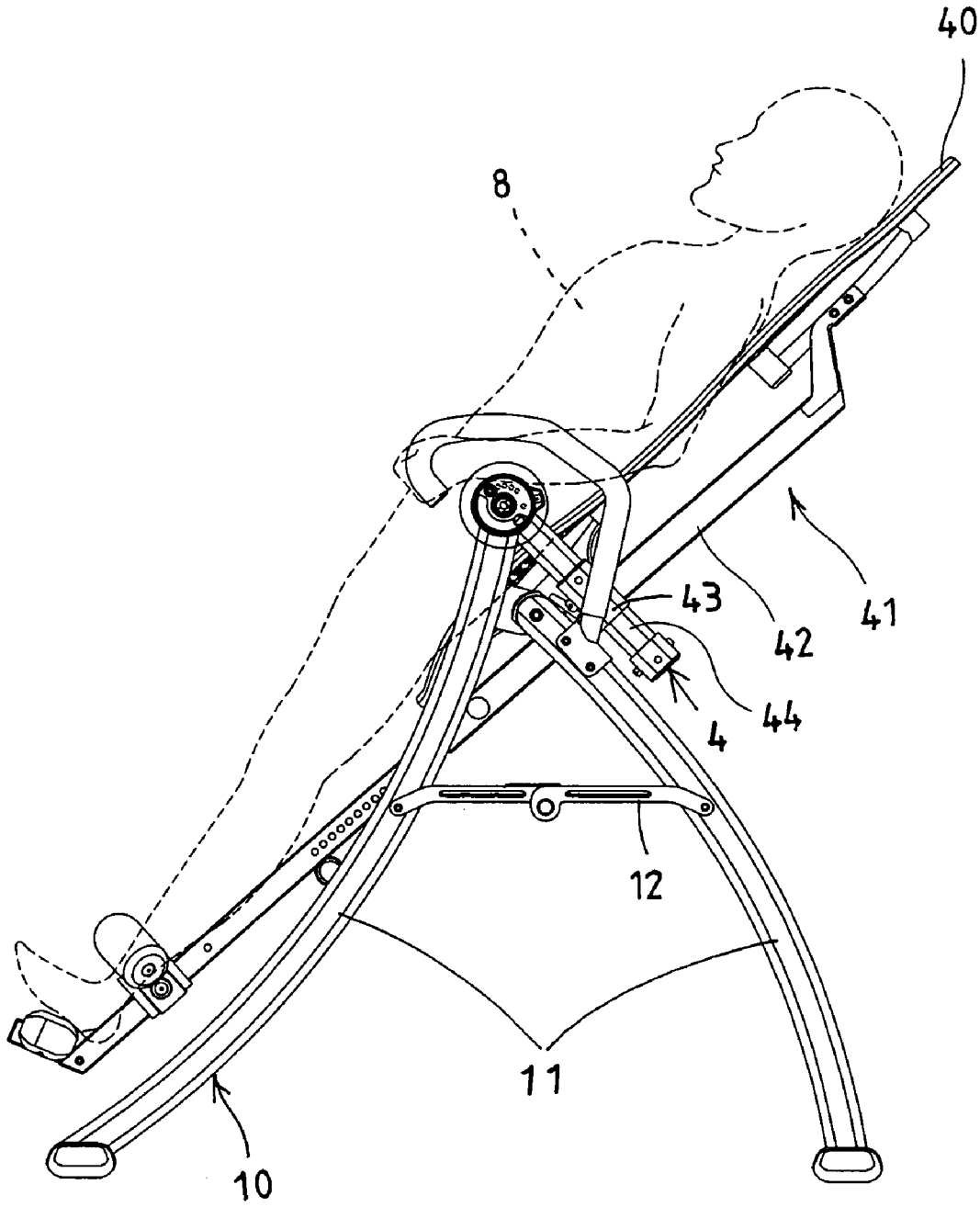
FIG. 9 is a side plan schematic view of the tilting inversion exerciser.
Figure 10:
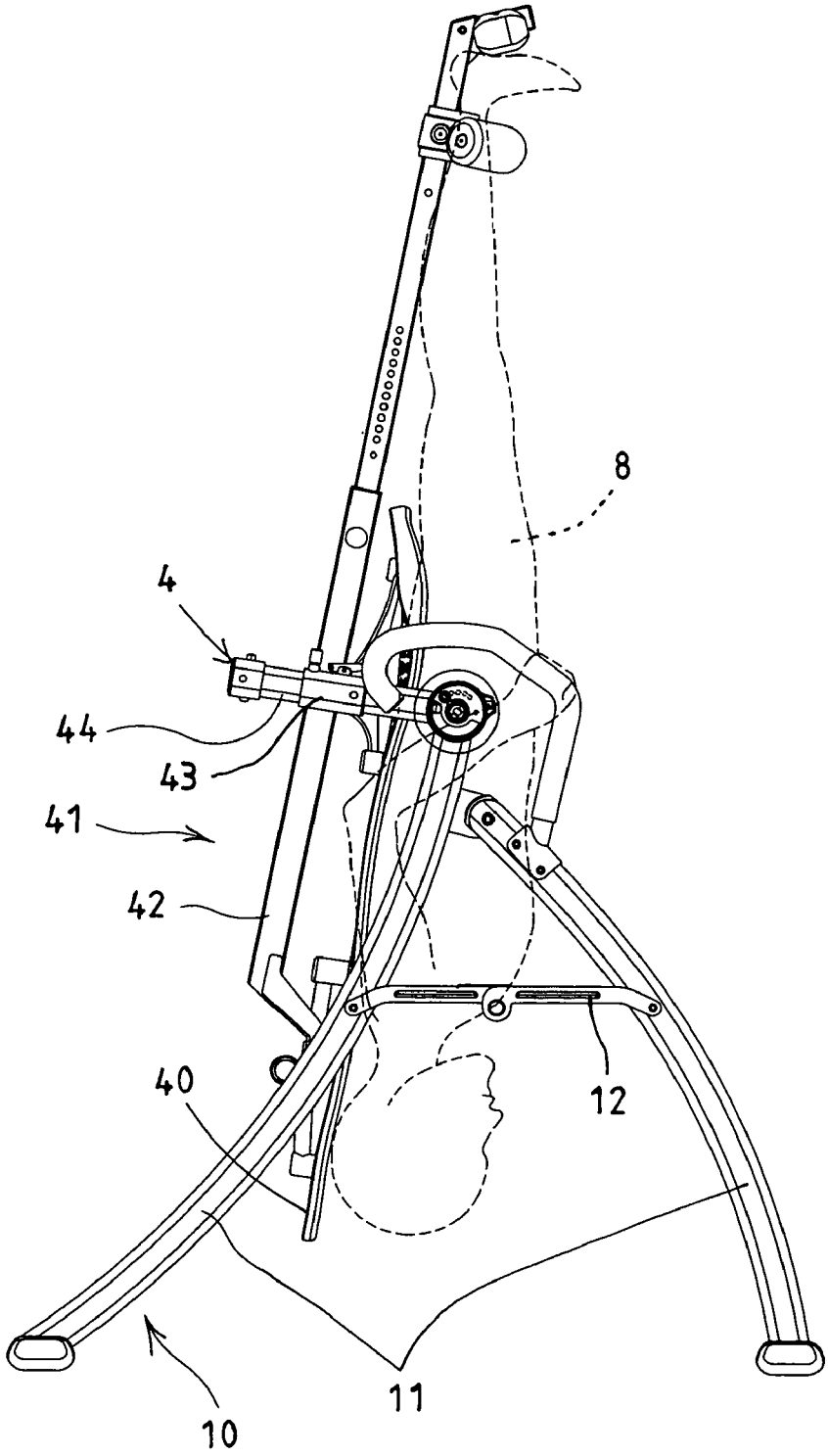
FIG. 10 is a side plan schematic view similar to FIG. 9 illustrating the operation of the tilting inversion exerciser.
Figure 12:
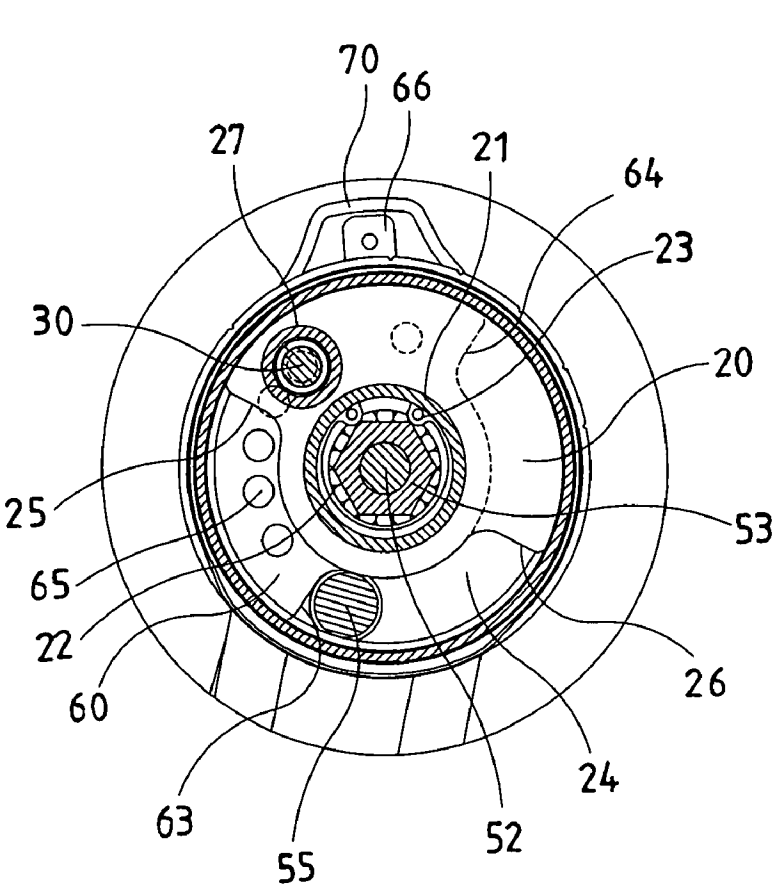
FIGS. 11, 12 are the other partial cross sectional views similar to FIGS. 7 and 8 illustrating the operation of the tilting inversion exerciser.
Figure 11:
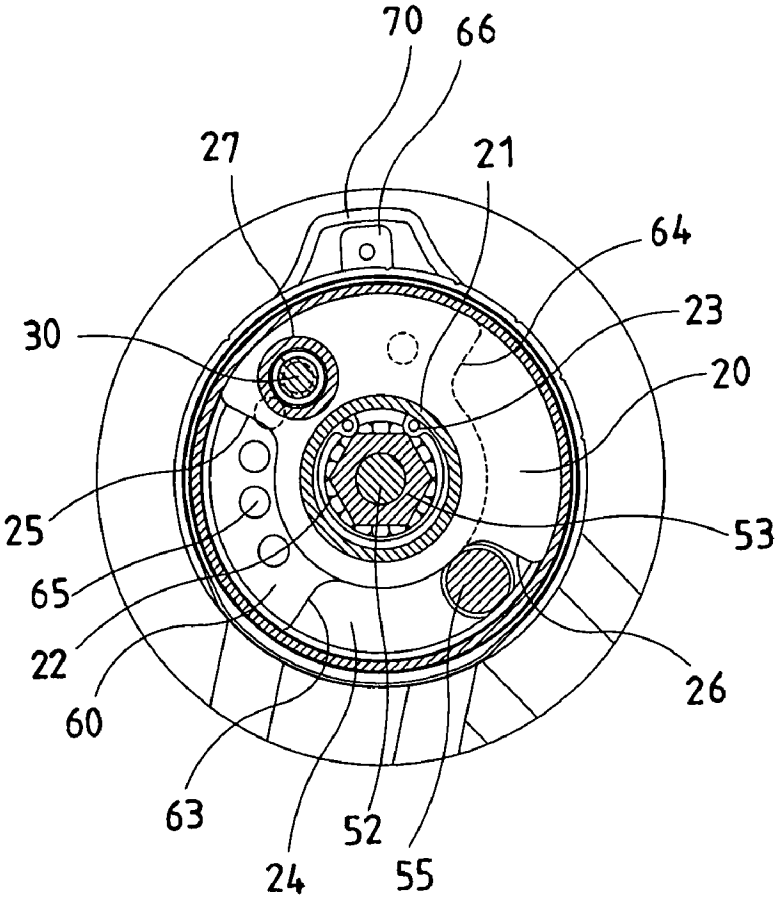
Figure 13:
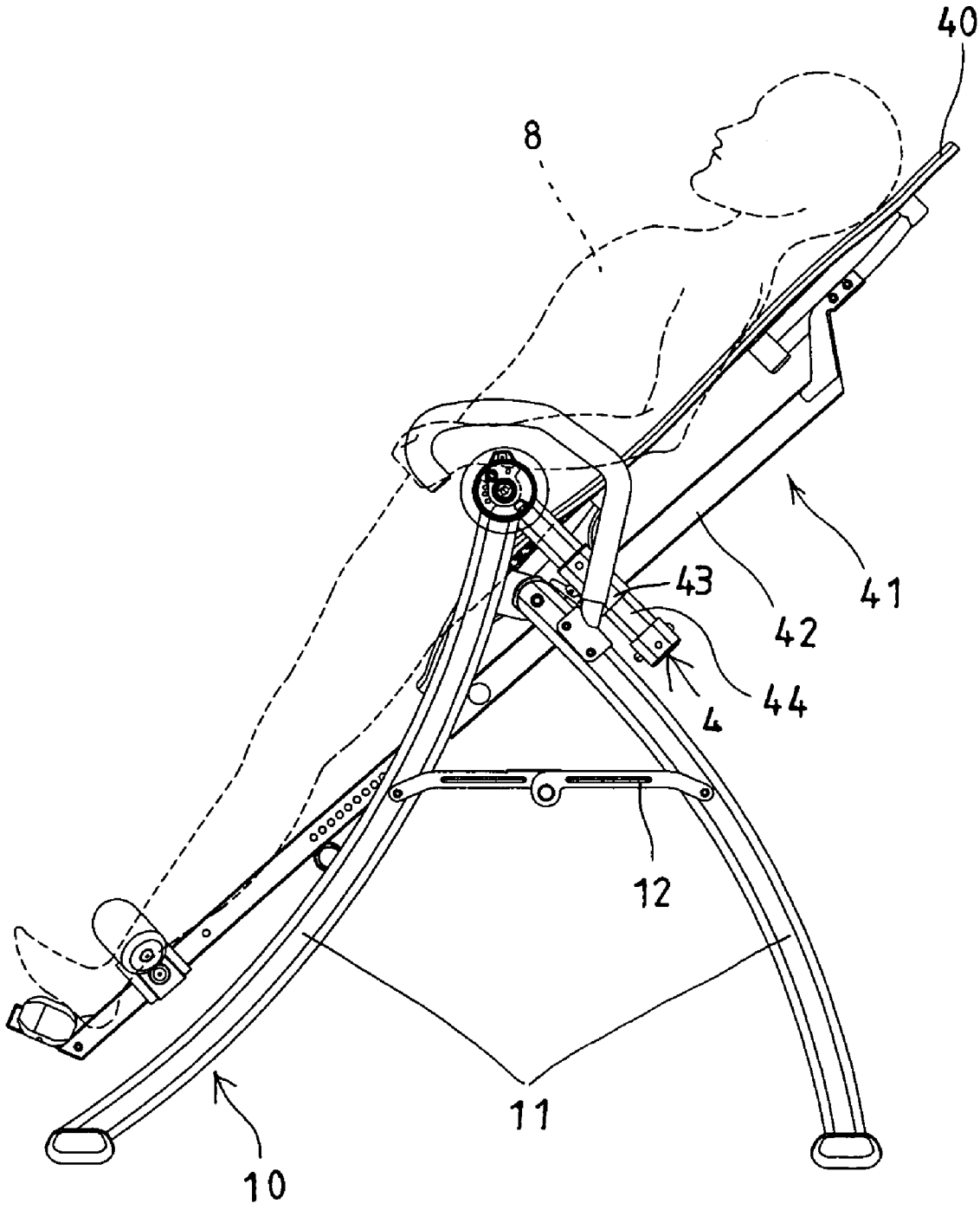
FIGS. 13, 14 are further side plan schematic views similar to FIGS. 9 and 10 illustrating the operation of the tilting inversion exerciser.
Figure 14:
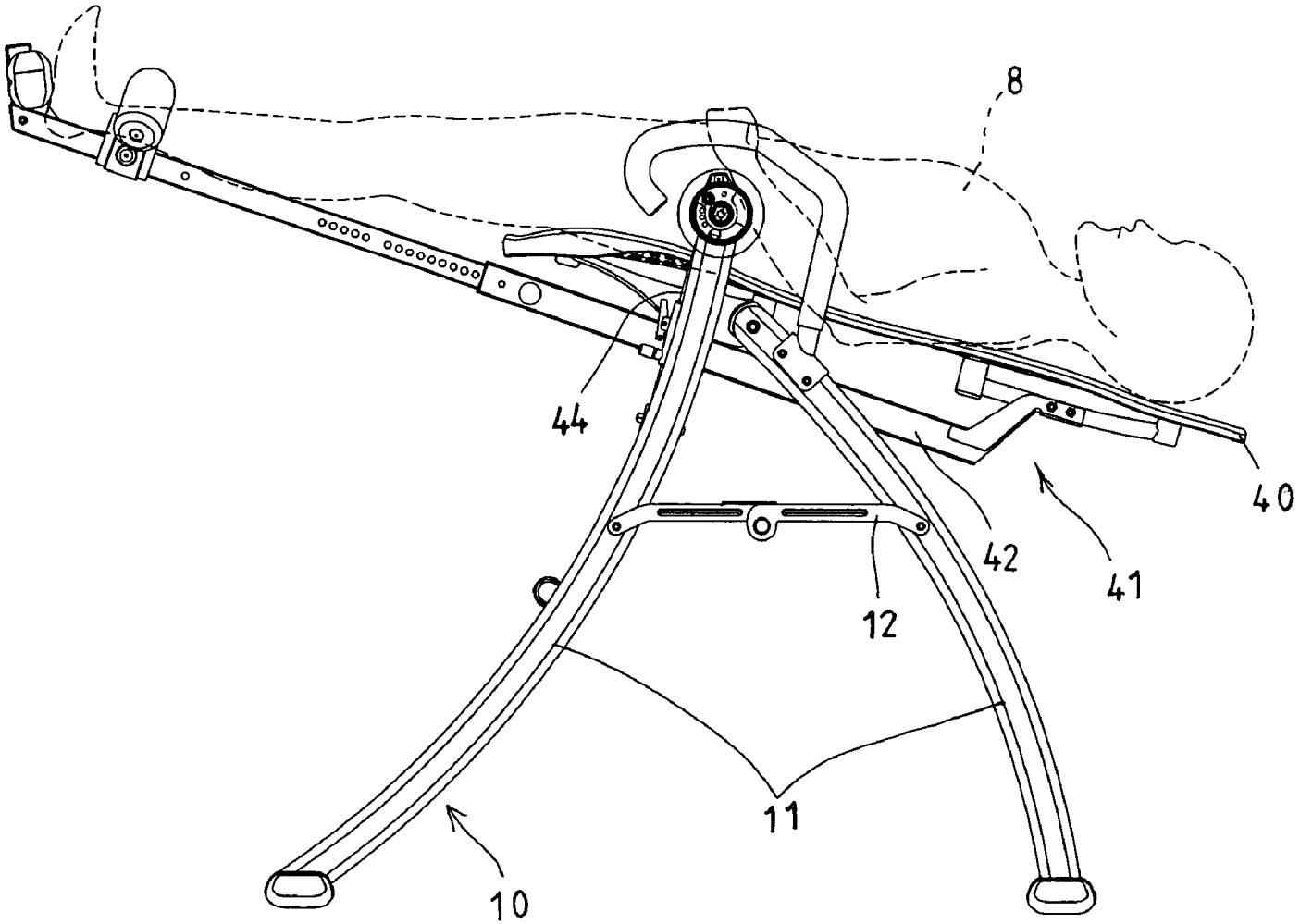

As shown in FIGS. 2-6, the lower supporting stand 10 includes one or more, such as two apex members or housings 13 disposed or attached to the upper ends of one of the stand members 11 of the lower supporting stand 10, or disposed on two side portions of the lower supporting stand 10, and the housings 13 each include a chamber 14 formed therein. A plate 20 is attached or secured to each of the housings 13, such as secured to the inner portion of each housing 13 with latches or fasteners (not shown), or by adhesive materials or welding procedures, and includes a compartment 21 formed therein for receiving a bearing 22 which is stably secured to the plate 20 with a locking or retaining ring 23, and includes a curved channel 24 formed therein and disposed or arranged around the compartment 21 and the bearing 22 and defined by two end stops 25, 26, and includes a barrel 27 extended outwardly therefrom and having a bore 28 formed therein for slidably receiving a latch member 30. The barrel 27 includes an outer thread 29 formed thereon (FIGS. 4-6).

As shown in FIGS. 4-6, the latch member 30 is slidably received in the bore 28 of the barrel 27 and includes an enlarged peripheral flange or stop 31 extended radially and outwardly therefrom for engaging with the barrel 27 and/or the plate 20 and for limiting the latch member 30 to slide relative to the barrel 27 and/or the plate 20 and/or the housing 13, a cap 32 is attached or secured to the barrel 27 for confining or retaining the latch member 30 within the bore 28 of the barrel 27, and the latch member 30 includes an actuating or latch end 33 extended out through the plate 20, and a spring member 34, such as a coil spring member 34 is engaged onto the latch member 30 and engaged with the peripheral flange or stop 31 of the latch member 30 and the barrel 27 and/or the cap 32 for biasing or forcing the actuating or latch end 33 of the latch member 30 to engage out through the plate 20.

A cover 15 is attached or secured to each of the housings 13, such as secured to the outer portion of each housing 13 for blocking or closing the chamber 14 of the housing 13, and includes an orifice 16 formed therein, and the latch member 30 includes an outer or free end 35 extended or engaged out through the orifice 16 of the cover 15 and attached or secured to a hand grip or knob 36 which may pull the latch member 30 relative to or against the spring member 34 and which may pull the actuating or latch end 33 of the latch member 30 inwardly or into the housing 13. In operation, as shown in FIG. 5, when the knob 36 is released, the spring member 34 may bias or force the actuating or latch end 33 of the latch member 30 to extend or to engage out through the plate 20. As shown in FIG. 6, when the knob 36 is pulled by the user, the actuating or latch end 33 of the latch member 30 may be pulled to move inwardly or into the housing 13.

The carrier 4 may further include one or more (such as two) apex members or casings 45 formed or attached or secured to the upper or free end of each of the arms 44 and aligned with the housings 13 of the lower supporting stand 10 respectively, and the casings 45 each include a chamber 46 formed therein, and each include a curved passage 47 formed therein (FIGS. 3, 4) and communicative with the chamber 46 of the casing 45. A board 50 is attached or secured to each of the casings 45, such as secured to the inner portion of each casing 45 with latches or fasteners (not shown), or by adhesive materials or welding procedures, and includes a bore 51 formed therein for receiving a pivot axle 52 which is engaged with the board 50 and the bearing 22 of the plate 20 and engaged with a lock nut 53 for rotatably attaching or securing or coupling the board 50 and the casing 45 to the housing 13, and for allowing the casing 45 and the arms 44 of the carrier 4 and the user supporting table 40 to be rotated relative to the housing 13 of the lower supporting stand 10.

The board 50 includes a screw hole or hub 54 for threading or attaching or securing a guide pin 55 to the board 50, and the guide pin 55 is slidably received and engaged in the curved channel 24 of the plate 20 (FIGS. 9, 10) and includes a noncircular actuating end 56 for guiding or limiting the board 50 and the casing 45 to rotate relative to the housing 13 of the lower supporting stand 10. A cover 48 may be attached or secured to each of the casings 45, such as secured to the outer portion of each casing 45 for blocking or closing the chamber 46 of the casing 45, and for covering or shielding or protecting the pivot axle 52 and for the dirt or contaminant from entering into the chamber 46 of the casing 45. A sleeve or ferrule or coupler collar 57 may further be provided and rotatably attached or engaged onto and between the housing 13 and the casing 45, and includes two opposite inner peripheral recesses 58, 59 formed therein (FIGS. 3-6) for engaging with the housing 13 and the casing 45 respectively and for stably positioning the housing 13 and the casing 45 to each other.

A panel 60 includes a bore 61 formed therein for rotatably receiving the pivot axle 52 and for rotatably attaching or securing the panel 60 onto the pivot axle 52 and into the casing 45, and includes a curved groove 62 formed therein and disposed or arranged around the bore 61 and the pivot axle 52 and defined by two end anchors 63, 64, and includes a number of apertures 65 formed therein (FIGS. 3-4, 7-8 and 11-12) for selectively aligning with the actuating or latch end 33 of the latch member 30 which may be selectively or changeably engage with either of the apertures 65 of the panel 60 for securing the panel 60 to the housing 13 at different angular position, and includes an ear 66 extended outwardly therefrom and slidably received and engaged in the curved passage 47 of the casing 45 for guiding or limiting the panel 60 to rotate relative to the casing 45.

A control ferrule 70 is pivotally or rotatably attached onto the casing 45, and includes a depression 71 formed therein for receiving or engaging with the ear 66 of the panel 60 and for anchoring or securing or coupling the panel 60 to the control ferrule 70 and for allowing the panel 60 to be pivoted or rotated relative to the casing 45 with the control ferrule 70 when the actuating or latch end 33 of the latch member 30 is disengaged from the panel 60. The actuating or latch end 33 of the latch member 30 may then be biased or forced to selectively or changeably engage with either of the apertures 65 of the panel 60 again by the spring member 34 when the knob 36 is released and when the panel 60 has been pivoted or rotated relative to the casing 45 to the required position with the control ferrule 70, in order to anchor or secure the panel 60 to the housing 13 at different or required angular positions.

In operation, as shown in FIGS. 7-10, the panel 60 may be pivoted or rotated relative to the casing 45 to align the curved groove 62 and the anchors 63, 64 of the panel 60 with the curved channel 24 and the end stops 25, 26 of the plate 20 for allowing the guide pin 55 and the board 50 and the casing 45 to be rotated or moved along both of the curved groove 62 of the panel 60 and the curved channel 24 of the plate 20, and to be engaged with the anchors 63, 64 of the panel 60 and the end stops 25, 26 of the plate 20, and for allowing the guide pin 55 and the board 50 and the casing 45 to be pivoted or rotated relative to the plate 20 and the housing 13 for the longest moving distance.

As shown in FIGS. 11-14, when the panel 60 is pivoted or rotated relative to the casing 45 to the other angular position with the control ferrule 70, and when the actuating or latch end 33 of the latch member 30 is changeably engaged with the other aperture 65 of the panel 60 for securing the panel 60 to the housing 13 at different angular position, one of the anchors 63 of the panel 60 may be moved or engaged into the curved channel 24 of the plate 20 for forming a relatively shortened moving path between the anchor 63 of the panel 60 and the end stop 26 of the plate 20, and for limiting the guide pin 55 of the board 50 to slide or move between the anchor 63 of the panel 60 and the end stop 26 of the plate 20, and thus for allowing the guide pin 55 and the board 50 and the casing 45 to be pivoted or rotated relative to the plate 20 and the housing 13 for a relatively shortened or decreased sliding or moving distance, and thus for allowing the tilting inversion exerciser to be workable with the users of worse body forms or physiques, such as the children and elders.

Accordingly, the tilting inversion exerciser in accordance with the present invention includes an angle adjusting mechanism for suitably adjusting the angular position between the user supporting table and the lower supporting stand and for limiting the user supporting table to rotate relative to the lower supporting stand and for preventing the user supporting table from being over rotated relative to the lower supporting stand.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tilting inversion exerciser comprising:

a supporting stand including two housings, each housing having: a plate with a curved channel formed therein and defined by a first end stop and a second end stop;

two arms, each arm associated with one of the two housings and having: a casing having a board pivotally attached and coupled to said plate of said housing with a pivot axle for pivotally coupling said casing to said housing, said board including a guide pin attached thereto and slidably received and engaged in said curved channel of said plate for guiding and limiting said board and said casing to rotate relative to said housing;

a user supporting table attached to said arms for pivoting relative to said housing of said supporting stand, at least one foot retaining means attached to said user supporting table comprising a pair of cylindrical pads for supporting a user when said user supporting table is pivoted relative to said housing of said supporting stand;

each housing of said two housings further having: a panel pivotally attached onto said pivot axle and including an anchor engageable into said curved channel of said plate for forming a shortened moving path between said anchor of said panel and said second end stop of said plate, and for limiting said guide pin of said board to slide along the shortened moving path between said anchor of said panel and said second end stop of said plate, a latch member slidably attached to said plate of said housing and engageable with said panel for changeably securing said anchor and said panel to said housing at different angular positions, a control ferrule is pivotally attached onto said casing and coupled to said panel for rotating said panel relative to said casing, said control ferrule includes a depression formed therein, and said panel includes an ear extended outwardly therefrom and engaged with said depression of said control ferrule for securing said panel to said control ferrule.

2. The tilting inversion exerciser as claimed in claim 1, wherein said panel includes a plurality of apertures formed therein for changeably engaging with said latch member and for changeably securing said panel to said housing at different angular positions.

3. The tilting inversion exerciser as claimed in claim 1, wherein said casing includes a chamber formed therein, and includes a curved passage formed therein and communicative with said chamber of said casing, and said ear of said panel is slidably received and engaged in said curved passage of said casing for guiding and limiting said panel to rotate relative to said casing.

4. The tilting inversion exerciser as claimed in claim 1, wherein said plate includes a barrel extended outwardly therefrom and having a bore formed in said barrel for slidably receiving said latch member.

5. The tilting inversion exerciser as claimed in claim 4, wherein said housing includes a cap attached to said barrel for retaining said latch member within said bore of said barrel.

6. The tilting inversion exerciser as claimed in claim 1, wherein said latch member includes a latch end extended out through said plate, and a spring member is engaged onto said latch member for biasing and forcing said latch end of said latch member to engage out through said plate.

7. The tilting inversion exerciser as claimed in claim 1, wherein said latch member includes a peripheral flange extended outwardly therefrom for engaging with said plate and for limiting said latch member to slide relative to said plate and said housing.

8. The tilting inversion exerciser as claimed in claim 1, wherein said housing includes a cover attached to said housing for blocking said chamber of said housing, said cover includes an orifice formed therein, and said latch member includes a free end extended out through said orifice of said cover and secured to a knob for pulling said latch member relative to said spring member.

9. The tilting inversion exerciser as claimed in claim 1, wherein a collar is rotatably engaged between said housing and said casing, and includes two opposite inner peripheral recesses formed therein for engaging with said housing and said casing respectively and for positioning said housing and said casing to each other.

10. The tilting inversion exerciser as claimed in claim 1, wherein said housing includes a compartment formed in said plate for receiving a bearing which is engaged with said pivot axle, and which is secured to said plate with a retaining ring.

* * * * *